US009385412B2

(12) United States Patent
Roberts

(10) Patent No.: US 9,385,412 B2
(45) Date of Patent: Jul. 5, 2016

(54) HARMONIC CAVITY RESONATOR

(71) Applicant: Brock F Roberts, Albuquerque, NM (US)

(72) Inventor: Brock F Roberts, Albuquerque, NM (US)

( * ) Notice: Subject to any disclaimer, the term of this patent is extended or adjusted under 35 U.S.C. 154(b) by 0 days.

(21) Appl. No.: 13/998,924

(22) Filed: Dec. 23, 2013

(65) Prior Publication Data

US 2016/0141743 A1 May 19, 2016

(51) Int. Cl.
*H01P 7/06* (2006.01)

(52) U.S. Cl.
CPC ..... *H01P 7/06* (2013.01)

(58) Field of Classification Search
CPC ..... H01P 7/06; H01P 1/208; H01P 1/2082
USPC ..... 333/227–233
See application file for complete search history.

(56) References Cited

U.S. PATENT DOCUMENTS 2,907,913 A * 10/1959 Dench ..... H01J 25/40 313/158
3,471,738 A * 10/1969 Bert ..... H01J 23/24 315/3.5
7,463,121 B2 * 12/2008 D'Ostilio ..... H01P 7/04 333/207

* cited by examiner

*Primary Examiner* — Robert Pascal
*Assistant Examiner* — Kimberly Glenn

(57) ABSTRACT

Cavity resonators have a multitude of applications in radio-frequency, microwave, and vacuum electronics. Cavity resonators are used as frequency selective filters and oscillators. In vacuum electronic devices and charged particle accelerators cavities are used to couple energy into and out of charged particle beams. Typically cavity resonators are optimized for single mode operation and are limited to sinusoidal waveforms and interactions. Harmonic cavities have many of the same applications, but because they resonate many axially symmetric harmonic modes simultaneously, the superposition of these modes is an on-axis arbitrary waveform. Harmonic cavities have both passive and active applications. When a periodic charged particle beam passes through a harmonic cavity whose resonances are at the same frequency as the beam's periodicity, the beam induces these cavity modes to resonate. The superposition of these modes, on axis, has a voltage vs. time waveform that ideally mirrors the current vs. time of the beam that induced it. Harmonic cavities can also be used to apply arbitrary waveforms to charged particle beams when driven externally. These waveforms can be used to modulate, shape, and accelerate the beam. A harmonic cavity whose axis is tilted to the beamline can be used to change the trajectory of selected particle bunches by delivering them fast kicking pulses.

2 Claims, 1 Drawing Sheet

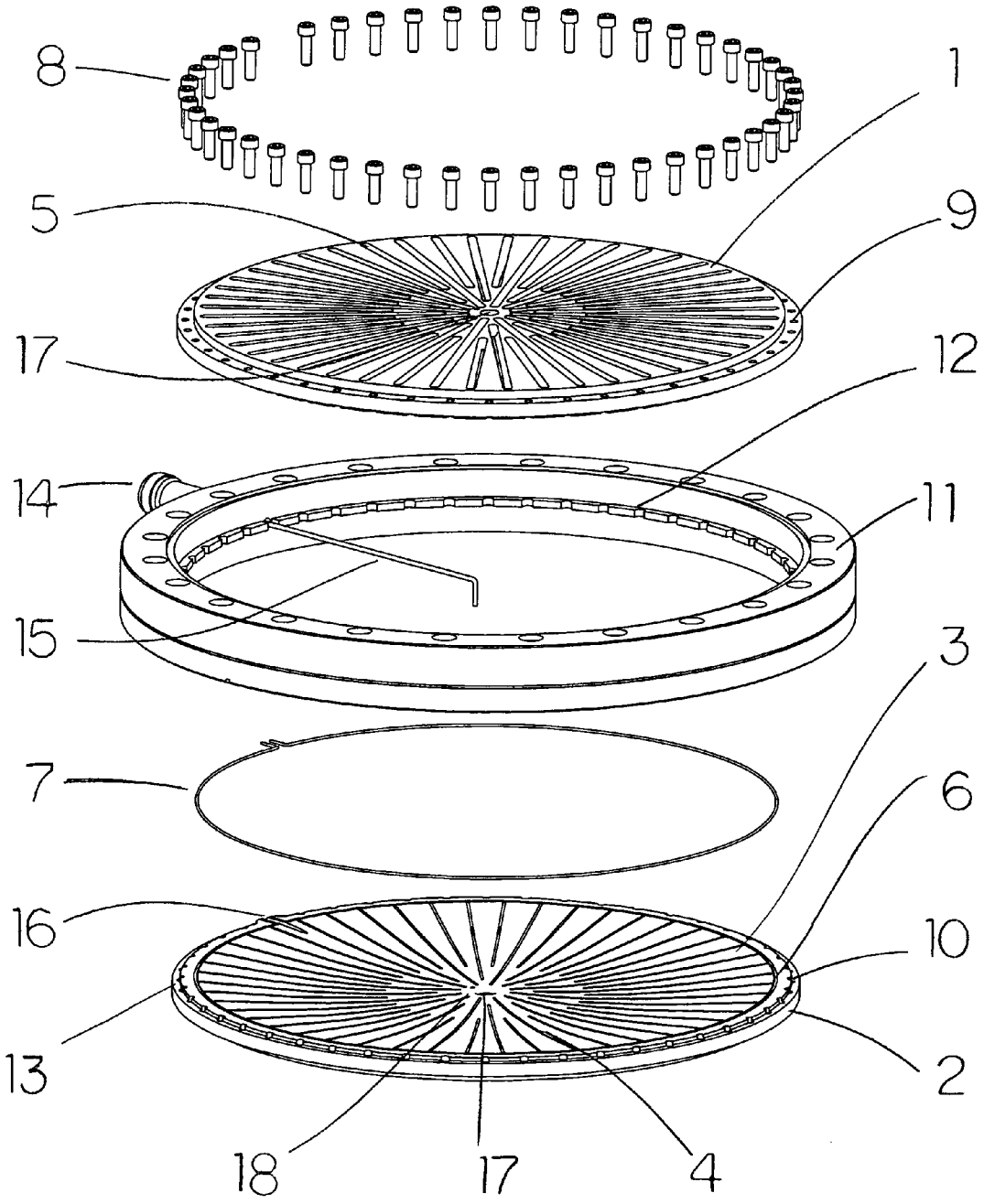
8
1
5
9
17
12
14
11
15
3
7
6
16
10
13
2
18
17
4

HARMONIC CAVITY RESONATOR

BACKGROUND

Cavity resonators are efficient, robust, electromagnetic devices that have a multitude of applications in radio-frequency, microwave, and vacuum electronics. Cavity resonators are used as frequency selective filters and oscillators. In vacuum electronic devices and charged particle accelerators cavities are used to couple energy into and out of charged particle beams. In the vast majority of these applications, only the fundamental frequency of the cavity resonator is utilized. The fundamental cavity mode generally has the greatest frequency separation from neighboring modes, has a simple field distribution, and can easily be made to be axially symmetric for interacting with an on-axis beam. The higher order modes in most cavity geometries are a mixture of transverse electric (TE) and transverse magnetic (TM) modes that increase in density with frequency until becoming a continuum. The mode spacing and fields of higher order modes are irregular and are generally undesirable in most applications. Applications that use single mode cavities are limited to sinusoidal waveforms and interactions.

Advantages

Harmonic cavities are designed to have many periodic axially symmetric transverse magnetic modes that can resonate simultaneously. Fouriers theorem summarizes the idea that any periodic function can be created by the superposition of harmonic sinusoidal waves. Because harmonic cavities can resonate multiple harmonic sinusoidal modes simultaneously, and because these modes are axially symmetric, a harmonic cavity can resonate an axial arbitrary waveform, limited in fidelity by its number of harmonic modes.

Harmonic cavities can be used as non-invasive beam monitors. When a periodic charged particle beam passes through a harmonic cavity whose resonances are at the same frequency as the beam's periodicity, the beam induces these cavity modes to resonate. The relative amplitude and phases of these modes are a manifestation of the beam's Fourier series. The superposition of these modes, on axis, has a voltage vs. time waveform that ideally mirrors the current vs. time of the beam that induced it.

Harmonic cavities have applications when driven externally with microwave energy. When several harmonics are driven simultaneously, the cavity's axial voltage vs. time is the superposition of these harmonics. Control of the amplitude and phase of these harmonics controls the cavity's axial voltage vs. time. These waveforms can be used to interact with a charged particle beam passing through the harmonic cavity's axial bore. Beam modulation, bunch shaping, and accelerating waveforms can be created and tailored by superimposing multiple harmonic modes within a harmonic cavity. A harmonic cavity whose axis is tilted to the beamline can be used to change the trajectory of selected particle bunches by delivering them fast kicking pulses.

DRAWINGS FIGURE

FIG. 1 is an exploded view of an embodiment of the invention.

REFERENCE NUMERALS IN DRAWING

1. cavity half A
2. cavity half B

3. saucer shape
4. radial slits
5. widened slits
6. wire groove
7. wire seal
8. fasteners
9. through-holes
10. threaded holes
11. vacuum flange
12. retaining ridge
13. relief for retaining ridge,
14. coaxial feedthrough
15. wire antenna
16. coaxial bore
17. beam bore
18. antenna termination

DESCRIPTION OF THE INVENTION

The harmonic cavities conductive enclosure is created by machining and assembling two metal cavity halves, (1) and (2), such that when assembled, the resultant cavity is a predetermined saucer shape (3). Thin radial slits (4) are cut through the cavity walls, and are widened (5) from behind the cavities interior surface. A semicircular cross section wire groove (6) is machined outside of the cavities perimeter in both halves to capture a wire seal (7). The harmonic cavity is assembled by passing fasteners (8), through through-holes (9) around the periphery of cavity half A (1), into threaded holes (10) in cavity half B (2). The wire seal (7) is compressed by tightening these fasteners (8).

A vacuum flange (11) with a retaining ridge (12) houses the harmonic cavity. A relief for the retaining ridge (13) is cut out of each cavity half, (1) and (2), so that the assembled cavity is retained within the vacuum flange. A vacuum coaxial feedthrough (14) penetrates the edge of the vacuum flange whose center conductor transitions into a wire antenna (15). The wire antenna enters the cavity through a coaxial bore (16) drilled through the cavities plane of symmetry toward the beam bore (17) where it bends parallel to the cavity axis and connects to ground at the antenna termination (18).

OPERATION OF THE INVENTION

The harmonic cavity resonator is designed to exclusively resonate many axially symmetric harmonic transverse magnetic (TM) modes. The cavities first, or fundamental mode is the $TM_{010}$ mode. Harmonic cavity resonators are designed such that the frequencies of the higher order axially symmetric transverse magnetic modes ($TM_{020}$, $TM_{030}$, etc.,) are harmonics of the fundamental. The cavity can be scaled in size to change its fundamental frequency.

The design of harmonic cavities relies on three criteria. Firstly, the cavity design excludes TE modes. A thin saucer-shaped cavity has a mode spectrum clear of TE modes for a wide bandwidth because TE modes resonate at frequencies $\geq c/2h$ where h is the cavities axial length. Secondly, the shape (3) of the cavity was designed so that the $TM_{0N0}$ modes are harmonic. This was accomplished by iteratively modifying the cavity's geometry and solving for the $TM_{0N0}$ mode frequencies with a 2-D electromagnetic field solver. Finally radial slits (4) cut into the cavities interior surface prevent the resonance of non-axially symmetric TM modes. The $TM_{0N0}$ modes have purely radial wall currents and are unaffected by these slits while the $TM_{MNP}$ modes with azimuthal mode numbers (M) less than the number of discontinuities are removed from the cavity's mode spectrum.

The preferred embodiment of the invention is assembled within a vacuum flange (11) to facilitate its inclusion into experimental apparatus. The radial slits (4) are widened behind the cavities surface (5) to increase vacuum conductance. The wire seal (7) provides an electrically conductive union between the two cavity halves and can be used as a tuning mechanism. Plastic deformation of the wire seal (7) slightly changes the cavities harmonic frequency by slightly decreasing its outer radius. The harmonic cavity shape (3) is relatively insensitive to scaling in axial length, providing design options for different applications. Thicker saucer shaped harmonic cavities have resonances with higher quality factors, but are limited in bandwidth by TE modes entering their mode spectrum. The thinner saucer shaped cavities have less efficient resonances, but have the widest bandwidth.

The vacuum coaxial feedthrough (14) has a bandwidth sufficient to exchange energy with the cavities harmonics and transitions into a wire antenna (15). The wire antenna enters the cavity through coaxial bore (16) drilled through the cavities plane of symmetry toward the beam bore (17) where it bends parallel to the cavity axis and connects to ground and is retained (18). Manipulating the height and curvature of this loop can be used to adjust mode coupling. A bore (17) through the cavities axis of symmetry allows for energy exchange between the cavities modes and charged particle beams. Because $TM_{0N0}$ cavity modes are axially symmetric and have a field maximum on the cavity axis, they all interact with a passing beam.

Harmonic cavities can be used as a non-invasive beam monitors. When a periodic charge particle beam passes through a harmonic cavity whose resonances are at the same frequency as the beam's periodicity, the beam induces these cavity modes to resonate. The relative amplitude and phases of these modes are a manifestation of the beam's Fourier series. The superposition of these modes, on axis, has a voltage vs. time waveform that ideally mirrors the current vs. time of the beam that induced it. This waveform is coupled from the modes induced by the beam to the antenna (15), and can be measured with a sampling oscilloscope connected to the coaxial feedthrough (14).

Harmonic cavities also have applications when their modes are driven by externally generated microwave energy. When many harmonics are driven simultaneously, the cavity's axial voltage vs. time is the superposition of these harmonics. Control of the amplitude and phase of these harmonics controls the cavity's axial voltage vs. time. This arbitrary waveform can be used to interact with charged particle beams passing through the harmonic cavities axial bore (17). Beam modulation, acceleration, and bunch shaping waveforms can be created and tailored by superimposing multiple harmonic modes within a harmonic cavity. A harmonic cavity whose axis is tilted to the beam line can be used to change the trajectory of selected particle bunches by delivering them fast kicking pulses.

Harmonic cavities can also be used as filters; a harmonic cavity with two antenna's communicating through the cavities resonance's will only pass complex high speed arbitrary waveforms with the same frequency as the cavities fundamental.

CONCLUSIONS RAMIFICATIONS AND SCOPE

Accordingly, the reader will see that there are many advantages to cavity designs that simultaneously resonates many periodic axially symmetric modes. Because these modes are axially symmetric, a harmonic cavity can resonate an axial arbitrary waveform that is either induced by, or designed to interact with, a charged particle beam passing through its bore (17).

While the above description contains many specificities, these should not be construed as limitations on the scope of the invention, but as an exemplification of an embodiment thereof. Many other variations are possible. For example the wire seal (7) could be a brazing alloy, or the assembly could be welded, or the conductive enclosure could be cast as a single piece. The cavity could be filled with a dielectric, the antenna could be a near axis electric field probe, or an electro-optic sensor. The beamline could be tilted relative to the harmonic resonators bore to deliver kicking pulses to selective charge bunches within a beam.

Thus the scope of the invention should be determined by the appended claims and their legal equivalents, rather than by the specifics of the embodiment described.

I claim:

1. A cavity resonator comprising:

a. A conductive enclosure with a predetermined saucer shape that has many axially symmetric transverse magnetic modes with harmonic resonant frequencies, b. means to exchange energy with the cavity resonator, c. a plurality of radial slits in said conductive enclosure, whereby exclusively resonating said many axially symmetric harmonic modes.

2. The cavity resonator of claim 1 that has an axial bore.

* * * * *